US007833317B2

(12) United States Patent
Lund Nilsen

(10) Patent No.: US 7,833,317 B2
(45) Date of Patent: Nov. 16, 2010

(54) SYSTEM AND METHOD FOR CONTROL OF GAS EMISSIONS FROM OIL STORAGE VESSEL

(76) Inventor: Inge Sverre Lund Nilsen, Nordahl Rolfsensvei 26 B, N-5094 Bergen (NO)

( * ) Notice: Subject to any disclaimer, the term of this patent is extended or adjusted under 35 U.S.C. 154(b) by 1122 days.

(21) Appl. No.: 10/548,493

(22) PCT Filed: Mar. 11, 2004

(86) PCT No.: PCT/NO2004/000065

§ 371 (c)(1),
(2), (4) Date: May 16, 2006

(87) PCT Pub. No.: WO2004/081440

PCT Pub. Date: Sep. 23, 2004

(65) Prior Publication Data

US 2006/0243344 A1 Nov. 2, 2006

(30) Foreign Application Priority Data

Mar. 11, 2003 (NO) ..... 20031111

(51) Int. Cl.
*B01D 47/00* (2006.01)

(52) U.S. Cl. ..... 95/156; 62/619; 141/59; 95/192; 95/216; 95/227; 95/228; 95/160; 96/234; 96/242; 96/275; 96/323

(58) Field of Classification Search ..... 141/59; 95/149, 216, 192–195, 156, 160, 203, 208, 95/227, 228; 96/234, 242, 275, 323; 26/DIG. 54
See application file for complete search history.

(56) References Cited

U.S. PATENT DOCUMENTS 3,898,998 A * 8/1975 Billberg ..... 137/113
4,112,825 A * 9/1978 Murata ..... 91/447
5,054,526 A * 10/1991 Perkins ..... 141/1
5,398,629 A * 3/1995 Wasenius ..... 114/74 R
5,443,547 A * 8/1995 Morikawa ..... 60/274
5,476,986 A * 12/1995 Jacobsen ..... 585/836

(Continued)

FOREIGN PATENT DOCUMENTS

NO 315820 10/2003

(Continued)

*Primary Examiner*—Duane Smith
*Assistant Examiner*—Ives Wu
(74) *Attorney, Agent, or Firm*—Venable LLP; Eric J. Franklin

(57) ABSTRACT

The invention relates to a system and a method for control of emission of volatile gases (VOC) from a holding tank (80) for crude oil during unloading, loading and transport/holding of the oil, such as in an oil tank on board an oil tanker, in which a blanket gas is used to regulate pressure and amount of combustible gas and to prevent ingress of oxygen into the mentioned holding tank for crude oil. The system comprises a recovery device (50) for recovery of hydrocarbon gas from the holding tank (80) for crude oil, a storage tank (18) for liquid hydrocarbons under pressure, supplied from the recovery device (50), and that liquid hydrocarbons are fed to an evaporation device (70) set up to convert liquid hydrocarbons to gas form, for use as blanket gas in a holding tank (80) for crude oil.

26 Claims, 3 Drawing Sheets

U.S. PATENT DOCUMENTS 5,524,456 A * 6/1996 Stokes ..... 62/619
6,015,451 A * 1/2000 Anderson et al. ..... 95/184
6,539,884 B1 * 4/2003 Husain et al. ..... 114/74 R
7,069,942 B2 * 7/2006 Trefall et al. ..... 137/14

FOREIGN PATENT DOCUMENTS

SU 281491 * 8/1974
WO WO 02/102654 A1 * 12/2002
WO WO 02/102654 A1 * 12/2002
WO WO 02102654 A1 12/2002

* cited by examiner

SYSTEM AND METHOD FOR CONTROL OF GAS EMISSIONS FROM OIL STORAGE VESSEL

The present invention relates to a system and a method for control of emissions of volatile gases (VOC) from a holding tank for crude oil during unloading, loading and transport/holding of the oil, such as in an oil tank on board an oil tanker, in which a blanket gas is used to regulate the pressure and to prevent ingress of oxygen in said holding tank for crude oil.

When transport of combustible fluids, it is essential that the atmosphere above the cargo has a low oxygen content so that combustible gas mixtures can not be formed. A small overpressure in the tanks is also important to prevent ingress of air.

When transporting of crude oil it is common to use an inert gas with low oxygen content as a blanket gas in the oil tanks. Inert gas is normally exhaust gas generated by burning diesel or other fuels. However, the inert gas in the tank will also contain appreciable amounts of hydrocarbons, due to the volatility of the cargo. When a tanker is loaded with oil, this gas will be displaced out of the tanks. Up until now, the most common method is to vent the gas to the atmosphere through the smoke stack on board the boat, something which leads to large emissions of volatile gases (Volatile Organic Compounds, VOC).

Emissions of VOC are considered to result in great environmental strains, especially locally. With the influence of sunlight, VOC react with nitrogen oxides and form ground level ozone. VOC are also considered to be greenhouse gases. Therefore, it is of great interest to reduce or eliminate emissions of VOC at loading of oil tankers.

The system described here is related to control of VOC emissions from oil tankers and other ships for transport of volatile fluids. More specifically, the system is designed to make it possible to eliminate emissions of VOC during loading, transport and unloading of such transport means.

The VOC control system is based on use of hydrocarbons as blanket gas in the tanks as a replacement for inert gas. Pure hydrocarbon gas will offer the same functional characteristics as inert gas, i.e. form an approximately oxygen free atmosphere and prevent ingress of air.

The advantage of using relatively pure hydrocarbon gas as blanket gas instead of inert gas, is that the pure hydrocarbon gas is considerably lighter and less energy demanding to recover than hydrocarbons mixed with inert gas.

Therefore, the aim of the invention is to provide a system in which the above mentioned disadvantages are avoided and which offers approximately emission-free VOC loading and unloading of oil tankers, or which provides the same advantages in connection with other holding units for combustible fluids.

This aim is achieved by a system as defined in the independent claim 1, wherein the system comprises a recovery device for recovery of hydrocarbon gas from the holding tank for crude oil, a storage tank for holding/intermediate storage of liquid hydrocarbons under pressure, which are supplied from the recovery device, and that liquid hydrocarbons are fed to an evaporation device arranged to convert liquid hydrocarbons to gas form, for utilisation as a blanket gas in the holding tank for crude oil. Preferred alternative embodiments of the system are characterised by the dependent claims 2-10.

The invention also relates to a method that is defined in the independent claim 11, and is characterised in that hydrocarbon gas is fed to the holding tank for crude oil as a blanket gas. Preferred alternative embodiments of the method are characterised by the dependent claims 12-21.

The invention shall now be described in more detail with reference to the enclosed figures, in which.

In the suggested system the hydrocarbon gas is recovered from the oil tanker during loading, the hydrocarbons are stored as liquid on board, and are evaporated and used as blanket gas when required. When needed, more hydrocarbon gas can also be generated from the cargo. This gas is condensed and is stored together with recovered gas.

The system for VOC control preferably encompasses the following principal parts:

1. Recovery part 50.
2. Storage of hydrocarbon blanket in a storage tank 18 gas under pressure at ambient temperature.
3. Evaporation of the stored liquid in an evaporation device 70.
4. System for generation of additional gas from the cargo (optional).

Figure 1:
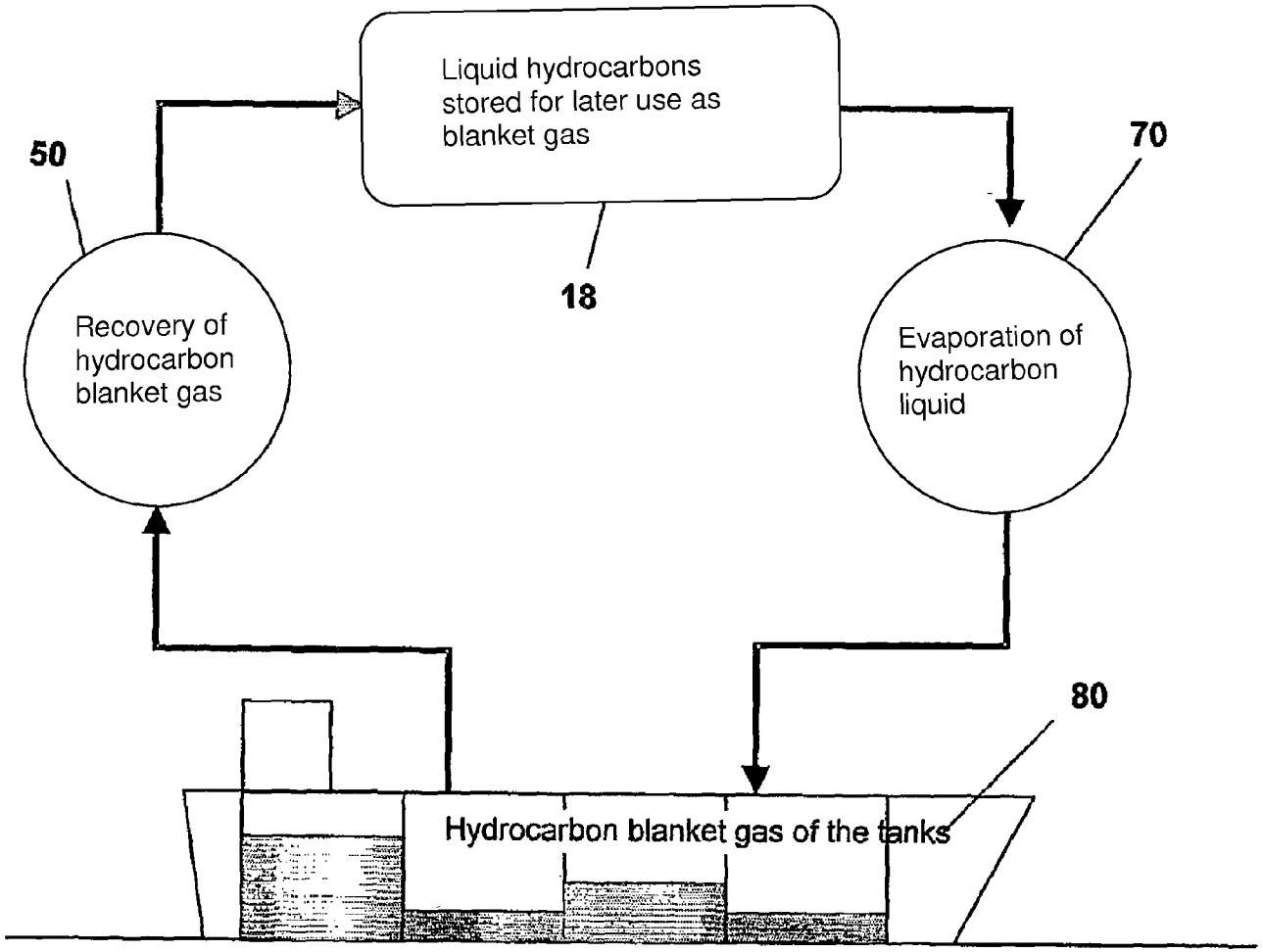
FIG. 1 shows a main principle diagram of a recovery process according to the present invention.
Figure 2:
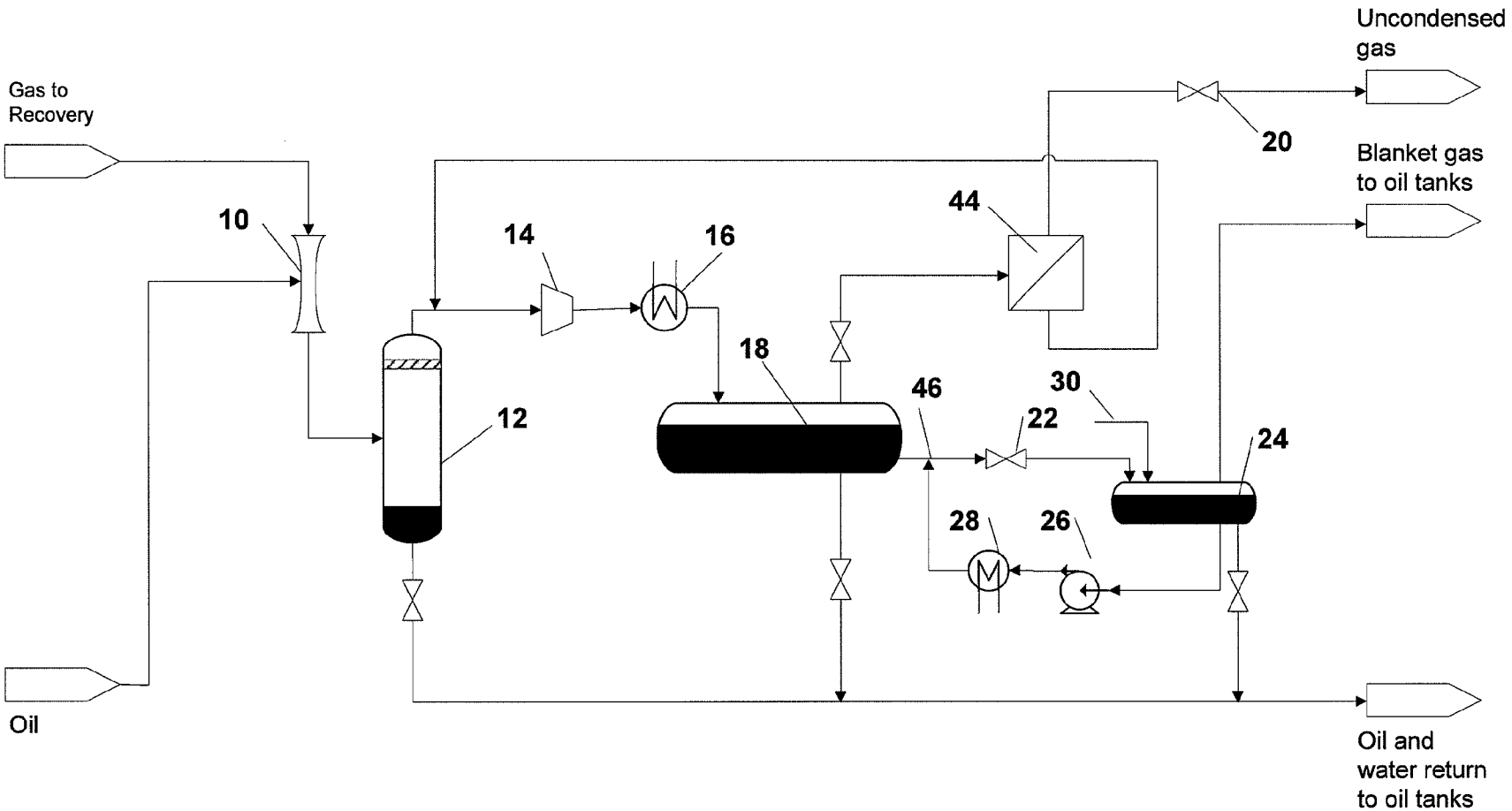
FIG. 2 shows a principle diagram of a preferred system according to the present invention.

A basic concept for the recovery process according to the invention is shown in FIG. 1. The present invention comprises a system incorporating a recovery device 50 for recovery of hydrocarbon gas from the holding tank 80 for crude oil, a storage tank 18 for holding/intermediate storage of liquid hydrocarbons under pressure, fed from the recovery device 50, and an evaporation device 70 arranged to convert liquid hydrocarbons, supplied from the storage tank 18, to gas form. The hydrocarbon gas which is separated from the evaporation device shall be used as blanket gas in the holding tank 80 for crude oil.

The recovery device 50 is preferably connected to a manifold in the holding tank 80, and comprises a compressor 14 and a condenser 16 arranged to cool the gas with the help of a cooling medium, whereby at least a part of the gas is condensed to liquid at the relevant operating pressure. Furthermore, the recovery device 50 comprises a gas wash 10, such as a venturi wash, and a separator tank 12, such as a venturi wash and separator tank/separator for oil and gas separation, arranged to clean hydrocarbon gas for particles and any other contaminants before the gas is fed to the recovery installation. The loaded crude oil is preferably used as the gas wash medium.

A storage tank 18 is placed between the recovery device 50 and the evaporation device 70, where the storage tank 18 is preferably arranged to also function as a separator, where the liquid and gas are separated and any excess gas is vented out of the tank.

Excess gas is then sent to a membrane separator 44 where the heavier components of the excess gas are concentrated on the low pressure side (permeate) and the lightest components are concentrated on the high pressure side (retentate). The low-pressure stream, which now is rich in heavier hydrocarbons, is re-circulated to the suction side of the compressor 14. Remaining light components are then released through a regulating valve 20. The regulating valve 20 is arranged to function as a pressure control valve that decides the storage pressure, condensation pressure, membrane pressure and the pressure at the outlet of the compressor 14.

The evaporation device 70 comprises a circulating heating medium which is heated up with the help of a preferred number of heat exchangers 28, an admixing point 46 where liquid gas is mixed with the heating medium, and a throttle valve 22 arranged to provide a pressure reduction in the mixture consisting of liquid gas that shall be evaporated and the mentioned heating medium, whereby the liquid gas is evaporated, and a separator tank 24 for separation and holding of hydrocarbon gas. The mentioned heat exchangers 28 can be connected in parallel or connected in series, and can comprise of conventional heat exchangers, such as plate heat exchangers, tubule bundle heat exchangers or other types of conventional heat exchangers, for example air coolers and evaporative air coolers.

The heating medium in the evaporation device must be set up to transport an amount of internal energy sufficient to maintain the mixture of heating medium and evaporated gas above the critical temperature for freezing or formation of hydrates after pressure reduction, where the mentioned heating medium can be comprised of, for example, fresh water, seawater, heavier hydrocarbons, glycol, methanol, or a mixture of several materials.

Figure 3:
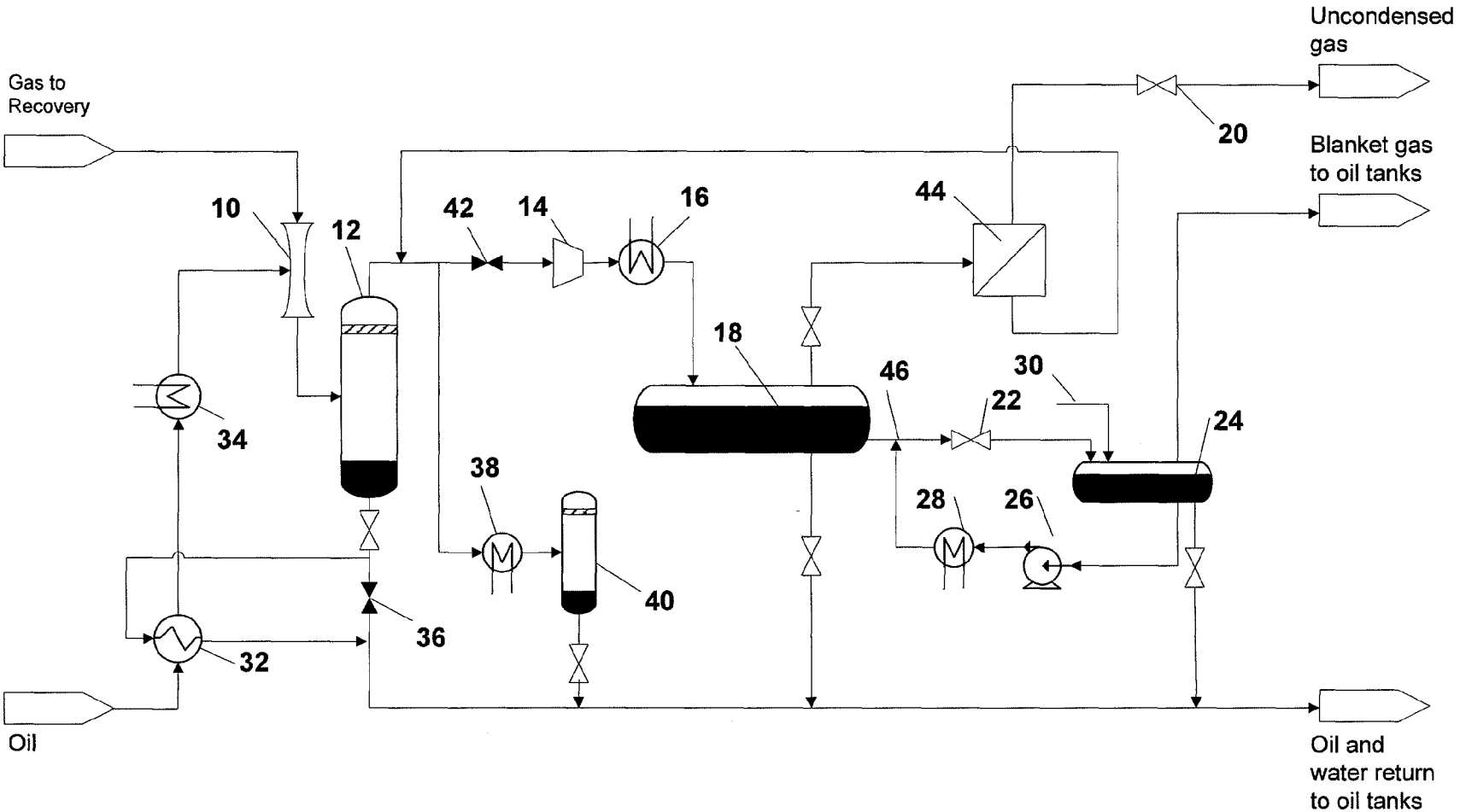
FIG. 3 shows a principle diagram of a further preferred system according to the present invention.

In an alternative embodiment as shown in FIG. 3, the recovery device, in connection to the gas wash 10 and the separation tank 12, can comprise a heat exchanger 32 and a heating unit 34, where the heat exchanger 32 is arranged to heat crude oil which is being loaded with the help of oil from the separator 12. A valve 36 can be fitted to the oil pipe/tube, which carries oil to the oil tank, and is set up to control the direction of flow of the heating medium.

In the alternative embodiment, a gas separator can also be arranged between the separator 12 and the compressor 14, comprising a gas cooler/condenser, a dew-point separator 40 and a valve 42 for control of the direction of flow, where the mentioned gas separator is set up to generate additional gas from the holding tank 80. The latter feature will, mainly, correspond to a solution that is described in the applicant's own patent application NO 20013298, which is described in more detail later in the description. The solution described in the mentioned patent application can consequently be incorporated in the present invention, and is preferably incorporated in the recovery device, but can also be placed in other ways known to any person skilled in the art.

In the following, the process itself in the system of control of emissions of volatile gases (VOC) from a holding tank for crude oil during unloading, loading and transport/holding of the oil, according to the present invention, shall be described in more detail.

Recovery is most relevant during loading of oil. During filling of the tanks, a gas volume corresponding to the added liquid volume is replaced. In addition, it is possible for light hydrocarbons to evaporate from the cargo, depending on the volatility of the cargo. This is known as "vapour growth".

The replaced gas is normally collected in a gas manifold which is equipped with the necessary safeguards against overpressure and vacuum. The recovery installation 50 is connected to this manifold and will, during operation, process an amount of gas corresponding to the replaced amount of gas, and in this way control the pressure in the tank and prevent emissions through the venting smoke stack.

Depending on the type of application, it can be necessary to clean the gas for particles and any other contaminants before the recovery installation 50. Cleaning of the gas can, for example, be carried out with the help of filtration or washing with a suitable washing medium in the gas wash 10. Special mention is given to use of dynamic gas washes such as venturi washes or jet scrubbers, or static gas washes such as wash towers. Special mention is given to use of oil (cargo) as a washing medium.

The gas wash 10 promotes contact between the washing medium and gas. Particles are best removed in dynamic washes where differences in the velocity of the fluids promote the ability of the liquid to catch the particles. Static washes such as wash towers with spray nozzles, plates or packing materials use counter-current contact between gas and washing medium, and thereby promote both the particle removal and absorption of contaminants.

After washing and separation in the separation tank 12, washed gas is led to a compressor, gas blower, fan, ejector or other pressure-increase appliances, hereafter called compressor 14. Screw compressors are especially suited to the recovery installations. The compressor 14 increases the gas pressure to a level sufficient for complete, or partial condensation by heat exchange against a suitable cooling medium. This pressure can be 1-20 barg depending on the gas composition and cooling medium. The compression can occur in one or several steps, with or without intermediate cooling, and with or without separation of liquid between the steps.

The compressed gas is further led to a heat exchanger for condensing with the help of a suitable cooling medium. The heat exchanger is hereafter given as condenser 16. The condenser 16 can be put together by one or more conventional heat exchangers coupled in parallel or coupled in series. The condenser 16 can, for example, be put together by plate heat exchangers, tube bundle heat exchangers or other types of conventional heat exchangers, and also air coolers and evaporative air coolers.

The cooling medium must be able to cool the gas so that at least a part of the gas is condensed to liquid at the operating pressure. The cooling medium can, for example, be air, fresh water or seawater.

A closed cooling circuit with fresh water or a mixture of water and glycol is also an alternative. A mechanical cooling installation with appropriate circulating cooling medium can also be used. Seawater will be a good alternative on board a tanker.

The amount of gas which is condensed will be dependent on the composition of the gas. With the use of hydrocarbons as blanket gas, the gas that is recovered will consist of a lot of hydrocarbons, and the condensation fraction could be high. Complete condensation will be possible, if not necessary.

The condensed or partially condensed gas is then conducted to one or more storage tanks 18. The storage tank 18 also functions as a separator, where liquid and gas are separated.

During operational disturbances, in connection with maintenance of the ship or the recovery installation, or during loading of not so volatile cargo, it can happen that inert gas must be used alone or in addition to hydrocarbons as blanket gas. Then, the recovery installation must handle gas that also contains inert gases. These gases are more difficult to condense, and the fraction of the gas that is condensed will then be reduced.

Excess gas is then conducted to a membrane separator 44 where the heavier components of the excess gas are concentrated on the low pressure side (permeate) and the lightest components are concentrated on the high pressure side (retentate). The low pressure flow which is now rich in heavier hydrocarbons is re-circulated to the suction side of the compressor 14. Remaining light components are released through a regulating valve 20.

The regulating valve functions as a pressure control valve, and determines the storage pressure, condensation pressure and the outlet pressure of the compressor 14. The storage pressure will be given by the necessary pressure for condensation in the previously mentioned condenser 16.

Some water will be separated out in the storage tank 18, as the replaced gas will contain water. The water can be drained out of the storage tank/separator when required.

The storage tank 18 or the tanks must have sufficient capacity to store sufficient amounts of liquid gas to be able to generate enough gas during unloading of the tanks of the tanker.

Recovery of gas from the ship's tanks can also be relevant during the crossing. For especially volatile cargo, gas could also evaporate during the crossing, and gas must therefore be removed from the tanks to prevent too high overpressure. The increase in temperature in the tanks will also result in evaporation of some of the cargo, in addition to leading to a general volume increase of the gas phase.

Evaporation of stored hydrocarbon liquid is first and foremost carried out during unloading of the oil cargo. This is done in order to refill the volume of oil that is pumped out of the ship, so that the necessary overpressure is maintained. Evaporation can also be relevant during crossing if some of the gas in the tanks is condensed in the cargo or, due to a decrease in temperature.

Hydrocarbons are stored as a liquid under pressure. To generate gas of atmospheric or near atmospheric pressure (below 1 barg) from a liquid stored at a pressure above 1 barg, the liquid must go through a pressure reduction. An amount of energy sufficient to evaporate the liquid must also be supplied.

The temperature of the liquid gas will be relatively similar to the temperature at which the liquid condensed at in the recovery. However, a certain increase in temperature or decrease in temperature because of heat exchange with the surroundings must be assumed.

When a volatile liquid stored under pressure goes through a pressure reduction, the temperature of the liquid will is lowered. This rapid temperature decrease is known as the Joule Thomson Effect, and is a result of the point of equilibrium between gas and liquid being altered in the direction of a larger gas fraction at a reduction in pressure. The equilibrium change results in a nearly instantaneous evaporation where the heat of evaporation comes from the internal energy of the liquid. Loss of internal energy (sensitive heat) results in an instantaneous decrease in the liquid temperature.

The stored liquid gas will contain water. Water is first and foremost dissolved as a consequence of an equilibrium between the water phase and the liquid phase of the hydrocarbon. But the liquid gas can also contain dispersed water which is difficult to separate in an ordinary tank.

Because of the water content, it is essential that the temperature is kept above freezing point or hydrate formation temperature during the whole evaporation process. This can be done in several ways, dependent on the energy source. It will be difficult to add heat, i.e. heat exchange against a suitable heating medium at the same time as the pressure is decreased. To avoid having to carry out the pressure reduction in more than one step, it is necessary to add all the required energy before throttling. This can be done by heating the liquid up to the necessary temperature, something which demands supply of heat from a suitable heat source with an adequate temperature level. A better alternative is to supply the necessary energy by means of a relatively large flow of liquid at relatively low temperature. The supplied flow of liquid, here called heating medium, is supplied under pressure and is mixed with the liquid gas just before throttling to the desired pressure.

The heating medium, which shall be in direct contact with the liquid gas, must not react with the gas. The heating medium should also have a relatively low vapour pressure. The heating medium can, for example, be fresh water, seawater, heavier hydrocarbons, glycol, methanol or a mixture of several materials. Special attention is drawn to the fact that a mixture of water and glycol or water and methanol can give a particularly favourable effect by functioning as an antifreeze liquid and thereby permit temperatures below 0 degrees Celsius. The heating medium can be used once (once through) or act in a circulating circuit. The latter is considered to be the most favourable.

The amount of heating medium must be so large that it can transport an amount of internal energy (sensitive heat) sufficient to keep the mixture of heating medium and evaporated gas above the critical temperature for freezing or hydrate formation after the pressure reduction. The amount of heating medium and the temperature of the heating medium should also be sufficient to give a final temperature high enough for a sufficient amount of gas to be evaporated at the actual outlet pressure.

Gas, heating medium and any remaining liquid gas that cannot be evaporated at the actual temperature and pressure, are conducted to the separator 24. The separation can be with the help of one or more conventional gravity separators, one or more cyclone separators or centrifuges.

After separation, the gas is led to the ship's holding tanks 80. The amount of liquid gas which is evaporated is controlled by considering how much is necessary to maintain the overpressure in the tanks 80. If parts of the liquid gas cannot be evaporated at the outlet pressure and the actual outlet temperature, this liquid must also be separated from the separator. This liquid can advantageously be returned to the ship's tank.

In the case of a closed circuit, the heating medium, which by now has a lower temperature than before the throttling, is pumped from the separator 24 to the heat exchanger 28 where the temperature is increased by means of heat exchange against a suitable heat source. The heat source can, for example, be seawater. The heating medium is re-circulated after heating and again mixed with the liquid gas. The closed circuit may require make-up 30 of heating medium, for example, water or another suitable heating medium because of losses from the system. Liquid must also be drawn regularly or continuously to prevent accumulation of soluble contaminants and particles.

Dependent on the cargo volatility, there can be a deficit of hydrocarbon blanket gas. This occurs when the oil in the tanks 80 absorbs some of the heavier components of the gas phase above the liquid surface instead of giving off gas (flashing) during loading. It can then be necessary to generate extra hydrocarbon blanket gas. The generated blanket gas ought to have the lowest possible molecular weight to minimise the absorption on the liquid surface in the oil tanks.

Generation of light blanket gas can be done by separating light hydrocarbons from the oil in the ship's tanks or directly from the loading manifold or unloading manifold during loading or unloading of oil. Separation or stripping of gas from the oil is carried out under vacuum, heating or combinations of vacuum and heating. Separation of gas from oil for use as a blanket gas is described in Norwegian Patent Application 2002 3298 which is hereby incorporated by reference.

A method is described in the mentioned Norwegian Patent Application 2002 3298 for handling of blanket gas or inert gas in connection with a tank that stocks or stores a cargo of crude oil or other oil related products, during successive unloading and loading operations of the tank, in that the blanket gas/inert gas is re-circulated in an approximately closed circuit by the following steps: that during unloading of the tank, blanket gas is produced from the cargo in manner known per se to fill the gradually increasing empty space in the tank, and as the tank is refilled with cargo, the tank gas is vented again and is compressed and absorbed in the cargo liquid.

An apparatus for carrying out the mentioned method is also described in the Norwegian patent application 2002 3298, comprising a cargo tank, a loading and unloading pipe, a branch pipe with a pump for transporting a fraction of the cargo, means for tempering the cargo fraction, a column or separator for atomising/evaporating of a cargo fraction, as a first pipe connects the top of the column to the cargo tank and a second pipe connects the bottom of the column with the cargo tank.

Separation of gas from oil can, for example, be carried out by pumping an oil stream from the ship's oil tanks, or directly from the loading or unloading manifold to a separating system for separation of gas or stripping of gas from the oil. The oil is first heated in a heat exchanger by means of returning, heated oil. Thereafter, the oil is heated further with the help of electricity, steam or other heating media. Heating can also be carried out with the help of excess heat from a compressor, for example, the system's recovery compressor. The heating ought to take place under pressure to prevent gas formation in the heat exchangers. The heated oil is then throttled to atmospheric pressure or vacuum and is conducted to a tank or separator where gas is separated from the oil.

A vacuum can be generated with by means of one or more compressors, vacuum pumps or ejectors. The compressor can preferably be the system's recovery compressor 14. An ejector can preferably be driven with the help of gas from the mentioned recovery compressor.

The generated gas will, depending on the composition, necessarily be conditioned before it can be used as a blanket gas directly, or be compressed by means of the recovery compressor 14, be condensed and stored in the storage tank 18 together with recovered gas. Conditioning can, for example, comprise cooling to separate out the heaviest components and thereby provide a light hydrocarbon gas suitable as blanket gas. The cooling medium can, for example, be air, fresh water or seawater. A closed cooling circuit with fresh water or a mixture of water and glycol is also an alternative. Seawater will be a suitable alternative on board tankers.

The system for separation of gas from the oil can preferably be combined with the recovery installation 50. This is particularly advantageous for generation of gas during transport and unloading as the recovery installation is not used for recovery then. Equipment for gas washing is then used as a separator of oil and gas after heating of the oil. Alternatively, the gas is conducted by way of a separate cooler with subsequent separation for conditioning, and then conducted to the recovery compressor. After compression, the gas is condensed completely or partially and the resulting liquid is stored in the storage tank together with recovered gas.

The invention claimed is:

1. A system for control of emission of volatile gases from a holding tank for crude oil during unloading, loading and transport/holding of the oil, wherein a blanket gas is used to regulate a pressure and amount of combustible gas and to prevent ingress of oxygen in the holding tank for crude oil, the system comprising:

a recovery device configured to wash/clean, compress and condense hydrocarbon gas from the holding tank for crude oil, thereby producing recovered liquid hydrocarbons, a storage tank configured to receive the recovered liquid hydrocarbons from the recovery device and to store the recovered liquid hydrocarbons under pressure, wherein the storage tank is arranged to also function as a separator, wherein liquid and gas are separated and any excess gas is vented out of the tank, and an evaporation device configured to receive the recovered liquid hydrocarbons from the storage tank and to convert the recovered liquid hydrocarbons to gas form, whereby the hydrocarbon gas is used as the blanket gas in the holding tank for crude oil, wherein the excess gas from the storage tanks is led to a membrane separator where heaviest components in the excess gas are concentrated in a product flow which is re-circulated to an inlet side of the compressor, and wherein remaining excess gas is vented out through a regulating valve, and wherein the regulating valve is arranged to function as a pressure control valve which determines a storage pressure, condensation pressure, membrane pressure and outlet pressure of the compressor.

2. The system according to claim 1, wherein the recovery device is connected to a manifold in the holding tank and comprises a compressor and a condenser arranged to cool the hydrocarbon gas with a cooling medium, whereby at least a part of the hydrocarbon gas is condensed to liquid at an operating pressure of the recovery device.

3. The system according to claim 2, wherein the recovery device comprises a gas wash and a separator tank configured to clean hydrocarbon gas for particles and any other contaminations before the gas is fed into the compressor of the recovery installation and condenser, and wherein the crude oil which is being loaded is used as a gas wash medium.

4. The system according to claim 1, wherein the evaporation device comprises a circulating heating medium which is heated with a number of heat exchangers, a throttle valve arranged to provide a pressure reduction in a mixture of liquid gas fed from the storage tank and the heating medium, whereby the liquid gas is evaporated, and a separator tank for separation and storage of the hydrocarbon gas.

5. The system according to claim 4, wherein the heat exchangers are coupled in parallel or coupled in series, and comprise conventional heat exchangers.

6. The system according to claim 4, wherein said heating medium in the evaporation device is arranged to transport an amount of internal energy sufficient to maintain the mixture of heating medium and evaporated gas above a critical temperature for freezing or hydrate formation after reduction in pressure, and wherein the heating medium comprises fresh water, seawater, heavier hydrocarbons, glycol, methanol, or a mixture of several materials.

7. The system according to claim 3, further comprising:

a heat exchanger and a heating unit arranged in connection with the gas wash and the separator tank, wherein the heat exchanger is arranged to heat the crude oil that is loaded with the help of oil from the separator, wherein a valve is set up to control the direction of flow of the heating medium, and wherein the gas separator is set up to generate additional gas from the holding tank.

8. The system according to claim 3, further comprising:

a gas separator arranged between the separator and the compressor, the gas separator comprising a gas cooler/condenser, a dew-point separator and a valve for control of the direction of flow, wherein the gas separator is arranged to control a dew-point of the generated gas.

9. A method to control emissions of volatile gases from a holding tank for crude oil during unloading, loading and transport/holding of the oil, the method comprising:

recovering volatile gas from crude oil in the holding tank, storing the volatile gas as liquid hydrocarbon gas, wherein the storage tank functions as a separator, wherein liquid and gas are separated, feeding the liquid hydrocarbon gas to an evaporation device, wherein the liquid hydrocarbon gas is stored in the storage tank before the liquid hydrocarbon gas is fed to the evaporation device, supplying the liquid hydrocarbon gas with heat from a heating medium before a pressure reduction with a throttle valve, converting the liquid hydrocarbon gas to gas form without the heating medium and evaporated gas coming down to a critical temperature for freezing or hydrate formation, supplying the holding tank for crude oil with hydrocarbon gas as the blanket gas to regulate a pressure and amount of combustible gas and to prevent ingress of oxygen in the holding tank, conducting excess gas from the storage tanks to a membrane separator where heaviest components in the excess gas are concentrated in a product stream, recirculating the product stream to an inlet side of the compressor, and venting remaining excess gas out through a regulating valve, wherein the regulating valve is arranged to function as a pressure control valve which decides the storage pressure, condensation pressure, membrane pressure and the outlet pressure of the compressor.

10. The method according to claim 9, further comprising:

conducting hydrocarbon gas, heating medium and any remaining liquid gas to a separator, and feeding the hydrocarbon gas after separation in the separator/tank to the holding tank for crude oil for application as the blanket gas.

11. The method according to claim 10, further comprising:

feeding the heating medium to a heat exchanger after separation in the separator, with the help of a circulation pump, increasing a temperature is increased with heat exchanging with a suitable heating source, and recirculating the heating medium after heating and again mixed with the liquid gas.

12. The method according to claim 9, further comprising:

before the liquid hydrocarbon gas is fed to the storage tank, recovering with a recovery device hydrocarbon gas from the holding tank for crude oil, wherein the recovery device comprises a compressor configured to pressurize the gas, and a heat exchanger configured to cool the gas with the help of a cooling medium, whereby at least a part of the gas is condensed to liquid at the actual pressure, and is fed to the storage tank.

13. The method according to claim 12, wherein the recovery device comprises a gas wash to clean the hydrocarbon gas for particles and any other contaminants before the gas is fed to the recovery installation and a separator to separate oil and gas, and wherein the crude oil that is being loaded is used as the gas wash medium.

14. The method according to claim 9, wherein the recovery device comprises a heat exchanger and a heating unit, and wherein the heat exchanger heats the crude oil which is being loaded with oil from the separator.

15. The method according to claim 9, wherein the method is carried out during unloading, loading and transport/holding of oil in an oil tank on board an oil tanker.

16. The method according to claim 15, wherein the recovery device comprises a gas separator encompassing a gas cooler/condenser, a dew-point separator and a valve for control of the direction of flow, and wherein the gas separator generates additional gas from the holding tank.

17. The method according to claim 9, wherein the hydrocarbon gas, heating medium and any remaining liquid gas are conducted to a gravity separator, or one or more cyclone separators or centrifuges.

18. The method according to claim 11, wherein the suitable heating source comprises seawater.

19. The system according to claim 1, wherein the unloading, loading and transport/holding of the oil is from/to an oil tank on board an oil tanker.

20. The system according to claim 4, wherein the heat exchangers comprise plate heat exchangers, tube bundle heat exchangers, air coolers, evaporative air coolers, or other types of conventional heat exchangers.

21. A system for control of emission of volatile gases from a holding tank for crude oil during unloading, loading and transport/holding of the oil, wherein a blanket gas is used to regulate a pressure and amount of combustible gas and to prevent ingress of oxygen in the holding tank for crude oil, the system comprising:

a recovery device configured to wash/clean, compress and condense hydrocarbon gas from the holding tank for crude oil, thereby producing recovered liquid hydrocarbons, a storage tank configured to receive the recovered liquid hydrocarbons from the recovery device and to store the recovered liquid hydrocarbons under pressure, and an evaporation device configured to receive the recovered liquid hydrocarbons from the storage tank and to convert the recovered liquid hydrocarbons to gas form, whereby the hydrocarbon gas is used as the blanket gas in the holding tank for crude oil, wherein the evaporation device comprises a circulating heating medium which is heated with a number of heat exchangers, a throttle valve arranged to provide a pressure reduction in a mixture of liquid gas fed from the storage tank and the heating medium, whereby the liquid gas is evaporated, and a separator tank for separation and storage of the hydrocarbon gas.

22. The system according to claim 21, wherein the heat exchangers are coupled in parallel or coupled in series, and comprise conventional heat exchangers.

23. The system according to claim 21, wherein said heating medium in the evaporation device is arranged to transport an amount of internal energy sufficient to maintain the mixture of heating medium and evaporated gas above a critical temperature for freezing or hydrate formation after reduction in pressure, and wherein the heating medium comprises fresh water, seawater, heavier hydrocarbons, glycol, methanol, or a mixture of several materials.

24. The system according to claim 21, wherein the heat exchangers comprise plate heat exchangers, tube bundle heat exchangers, air coolers, evaporative air coolers, or other types of conventional heat exchangers.

25. A method to control emissions of volatile gases from a holding tank for crude oil during unloading, loading and transport/holding of the oil, the method comprising:

recovering volatile gas from crude oil in the holding tank, storing the volatile gas as liquid hydrocarbon gas, feeding the liquid hydrocarbon gas to an evaporation device, supplying the liquid hydrocarbon gas with heat from a heating medium before a pressure reduction with a throttle valve, converting the liquid hydrocarbon gas to gas form without the heating medium and evaporated gas coming down to a critical temperature for freezing or hydrate formation, supplying the holding tank for crude oil with hydrocarbon gas as the blanket gas to regulate a pressure and amount of combustible gas and to prevent ingress of oxygen in the holding tank, conducting hydrocarbon gas, heating medium and any remaining liquid gas to a separator, and feeding the hydrocarbon gas after separation in the separator/tank to the holding tank for crude oil for application as the blanket gas.

26. The method according to claim 25, further comprising:

feeding the heating medium to a heat exchanger after separation in the separator, with the help of a circulation pump, increasing a temperature is increased with heat exchanging with a suitable heating source, and recirculating the heating medium after heating and again mixed with the liquid gas.

* * * * *